US007494380B2

(12) United States Patent
Lai

(10) Patent No.: US 7,494,380 B2
(45) Date of Patent: Feb. 24, 2009

(54) MULTIPURPOSE MULTIPLE-SLOT CARD CONNECTOR FOR USE WITH SINGLE CARD ONCE ONLY

(75) Inventor: Yaw-Huey Lai, Taipei County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 246 days.

(21) Appl. No.: 11/642,774

(22) Filed: Dec. 21, 2006

(65) Prior Publication Data

US 2008/0102707 A1 May 1, 2008

(30) Foreign Application Priority Data

Oct. 25, 2006 (TW) ..... 95218887 U

(51) Int. Cl.
*H01R 24/00* (2006.01)

(52) U.S. Cl. ..... 439/630; 439/946

(58) Field of Classification Search ..... 439/630, 439/946, 541.5, 945

See application file for complete search history.

(56) References Cited

U.S. PATENT DOCUMENTS 6,666,724 B1 12/2003 Lwee
6,726,508 B2 * 4/2004 Watanabe et al. ..... 439/677
7,153,165 B2 * 12/2006 Lai et al. ..... 439/630
2003/0119365 A1 * 6/2003 Watanabe et al. ..... 439/630
2004/0266267 A1 * 12/2004 Inaba ..... 439/630
2006/0057894 A1 * 3/2006 Tsai ..... 439/630
2006/0270278 A1 * 11/2006 Lai et al. ..... 439/630

* cited by examiner

*Primary Examiner*—Gary F. Paumen
(74) *Attorney, Agent, or Firm*—Bacon & Thomas, PLLC

(57) ABSTRACT

A multi-purpose multiple-slot card connector for use with one single card once only includes a base frame having three slots defined as a left slot, a right slot, and an upper slot, a partition spacing the left slot from the right slot, and a spacer located at a bottom side of the upper slot and having a first hollow portion formed at a midsection thereof; a horizontal swivel member located between the left and right slots and two stop walls for interference with either of the left and right slots; a vertical pivot member corresponding to the first hollow portion and pivotably mounted to two lateral sidewalls of the upper slot and having a stop plate and two extensions extending toward one side from the stop plate and located above the left and right slots; and a plurality of terminals mounted in each of the slots.

6 Claims, 9 Drawing Sheets

MULTIPURPOSE MULTIPLE-SLOT CARD CONNECTOR FOR USE WITH SINGLE CARD ONCE ONLY

BACKGROUND OF THE INVENTION

1. Field of the Invention

The present invention relates generally to the connecting technology of memory cards for electronic apparatuses, and more particularly, to a multi-purpose multiple-slot card connector for use with a single card once only.

2. Description of the Related Art

As disclosed in U.S. Pat. No. 6,666,724 entitled "MULTI-PURPOSE CARD CONNECTOR", a conventional multi-purpose card connector for use with a single card at a time only disclosed an upper slot and a lower slot for receiving respective electronic cards, and a switching block located between the upper and lower slots. After a card is inserted into the upper slot, the switching block pivots downward to block the lower slot to prevent the lower slot from insertion of another card. On the contrary, after a card is inserted into the lower slot, the switching block pivots upward to block the upper slot to prevent the upper slot from insertion of another card.

However, there are more and more specifications of electronic cards and the above-mentioned art has failed to be applied to a card connector having multiple slots, like three slots, for use with one single card at a time only.

SUMMARY OF THE INVENTION

The primary objective of the present invention is to provide a multi-purpose multiple-slot card connector, which has more than two slots for use with one single card at a time only to prevent another card from inserting therein.

The foregoing objective of the present invention is attained by the multi-purpose multiple-slot card connector, which is composed of a base frame, a horizontal swivel member, a vertical pivot member, and a plurality of terminals. The base frame includes three slots defined as a left slot, a right slot, and an upper slot. The left and right slots are adjacent to and spaced from each other by a partition. A spacer is located at a bottom side of the upper slot for spacing the upper slot from the left and right slots, having a first hollow portion formed at a midsection thereof. The spacer is also located above the partition and the left and right slots. The swivel member includes an axis rotatably mounted to the base frame and located between the left and right slots for leftward and rightward swiveling movement on the axis. The swivel member further includes two stop walls, each of which has an imaginary line extending outward from the axis to intersect with the other for a predetermined angle for interference with either of the left and right slots while swiveling. The pivot member corresponds to the first hollow portion and includes a pivot shaft pivotably mounted to the base frame and located at two lateral sidewalls of the upper slot, a stop plate extending outward from the pivot shaft, and two extensions extending toward one side from the stop plate and located above the left and right slots, for downward pivoting movement on the pivot shaft. While the pivot member pivots downward, the two extensions interfere with the left and right slots. The terminals are mounted in each of the slots.

DETAILED DESCRIPTION OF PREFERRED EMBODIMENTS

Figure 1:
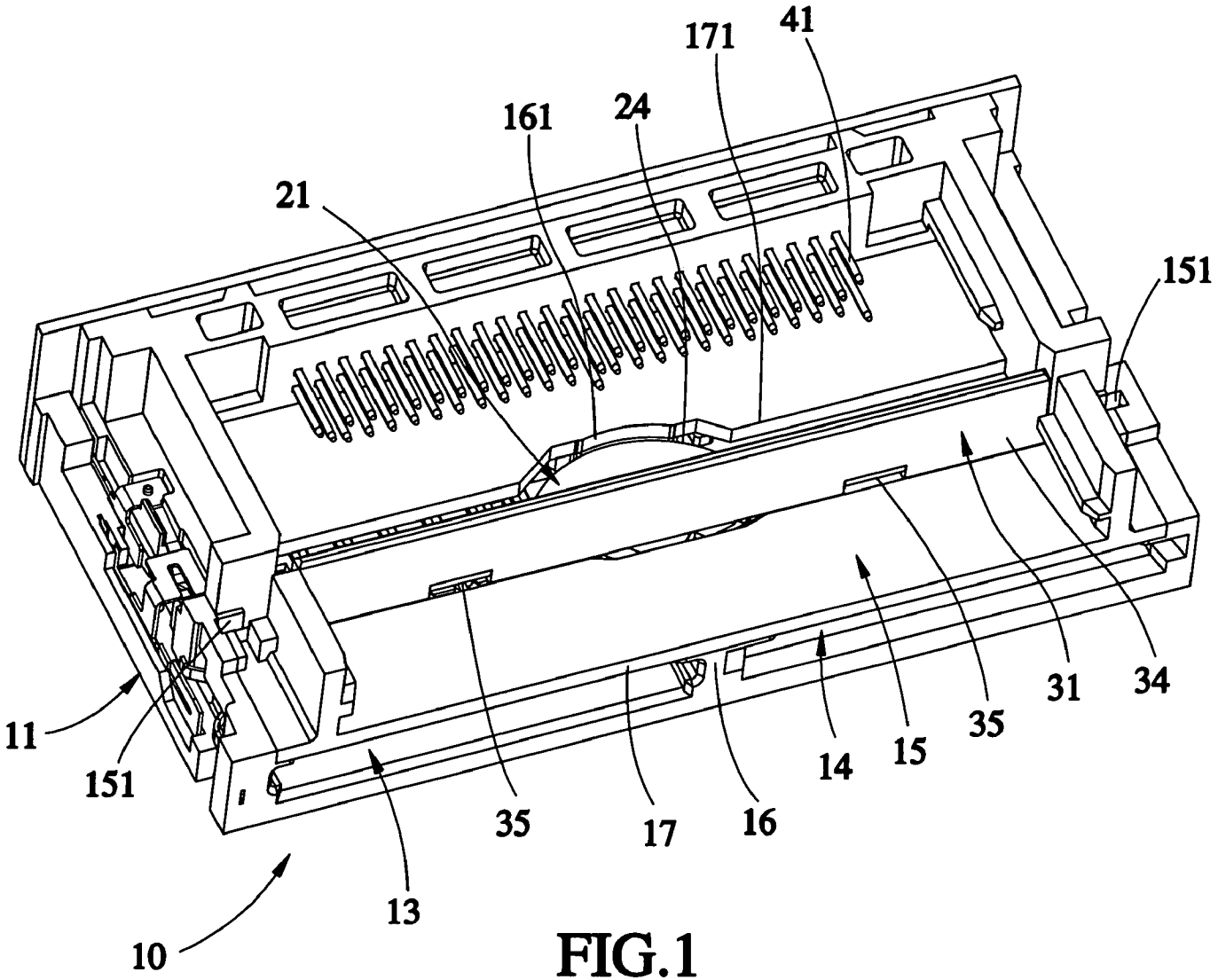
FIG. 1 is a perspective view of a preferred embodiment of the present invention.
Figure 2:
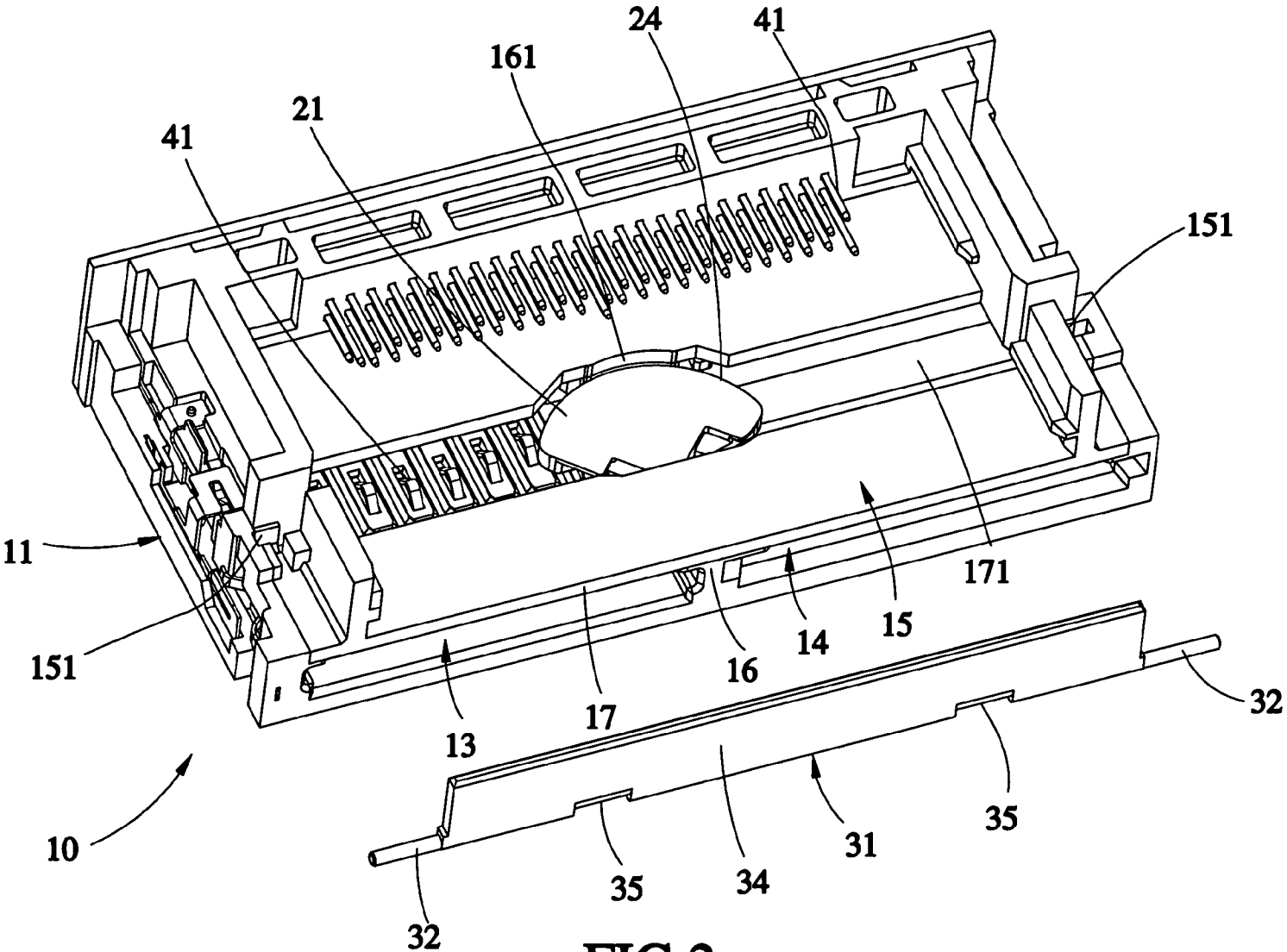
FIG. 2 is a partial exploded view of the preferred embodiment of the present invention, illustrating how the pivot member is mounted to the base frame.
Figure 3:
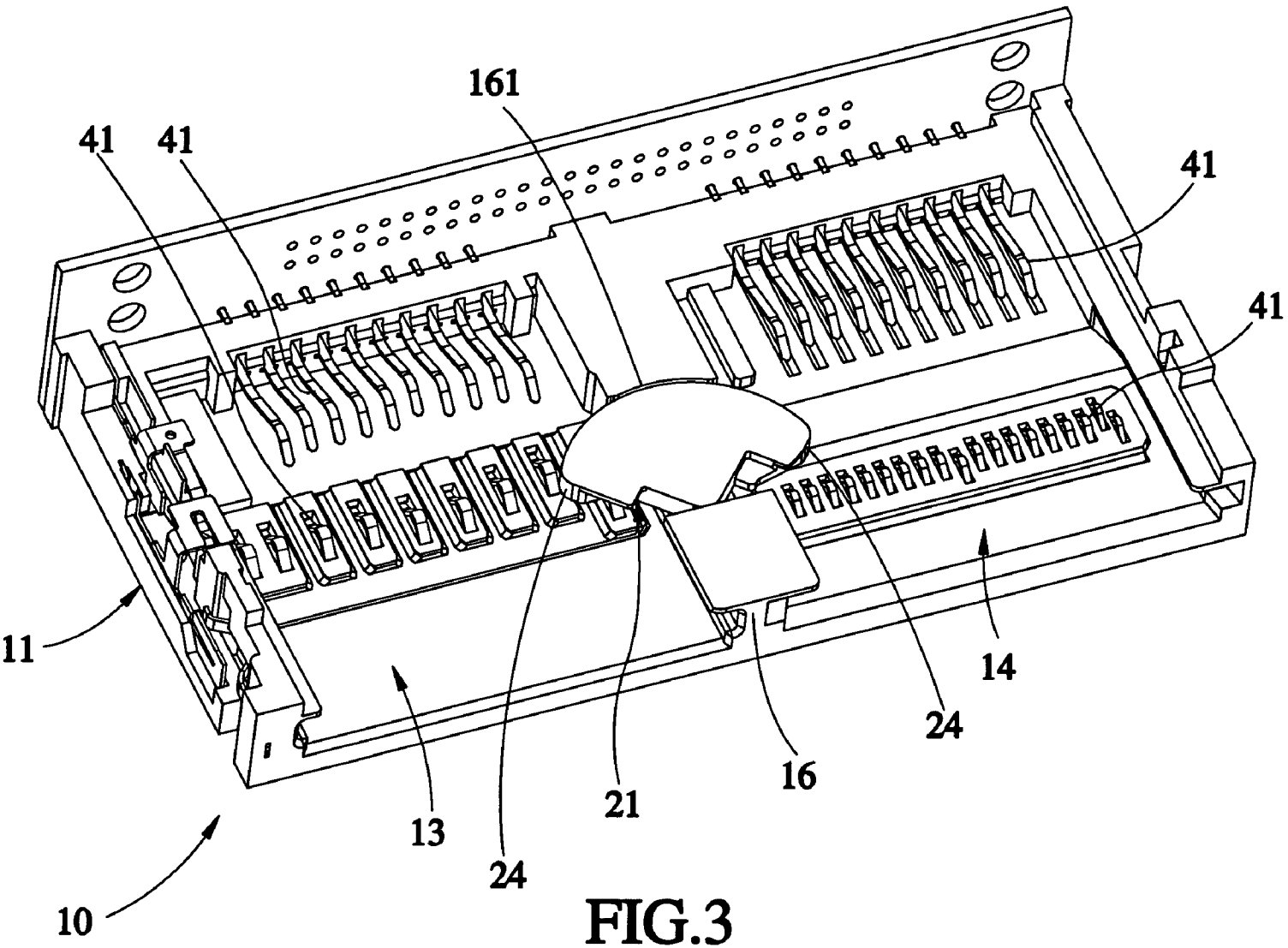
FIG. 3 is a partial sectional perspective view of the preferred embodiment of the present invention, illustrating the positional relationship among the left and right slots and the swivel member.
Figure 4:
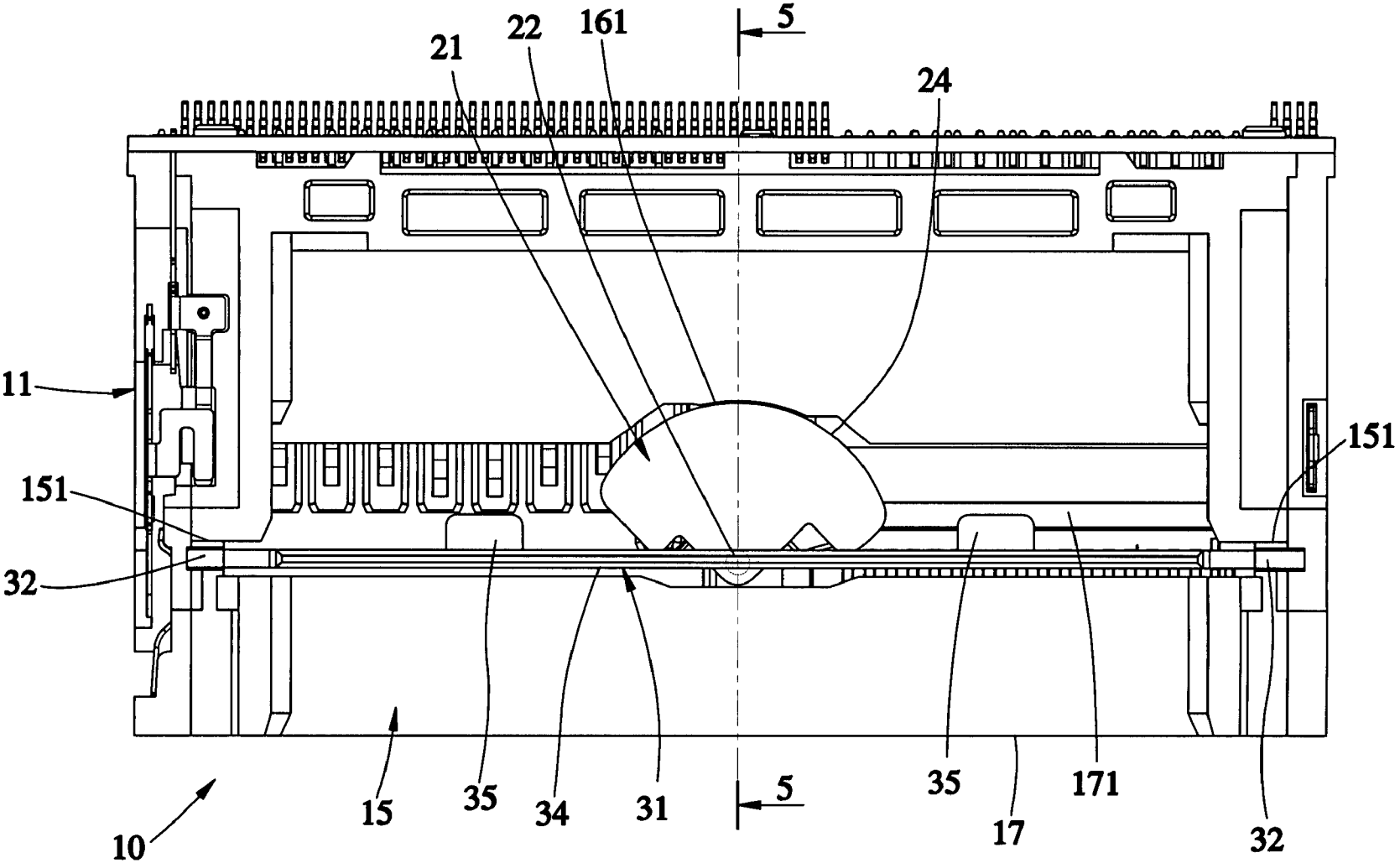
FIG. 4 is a top view of the preferred embodiment of the present invention.
Figure 5:
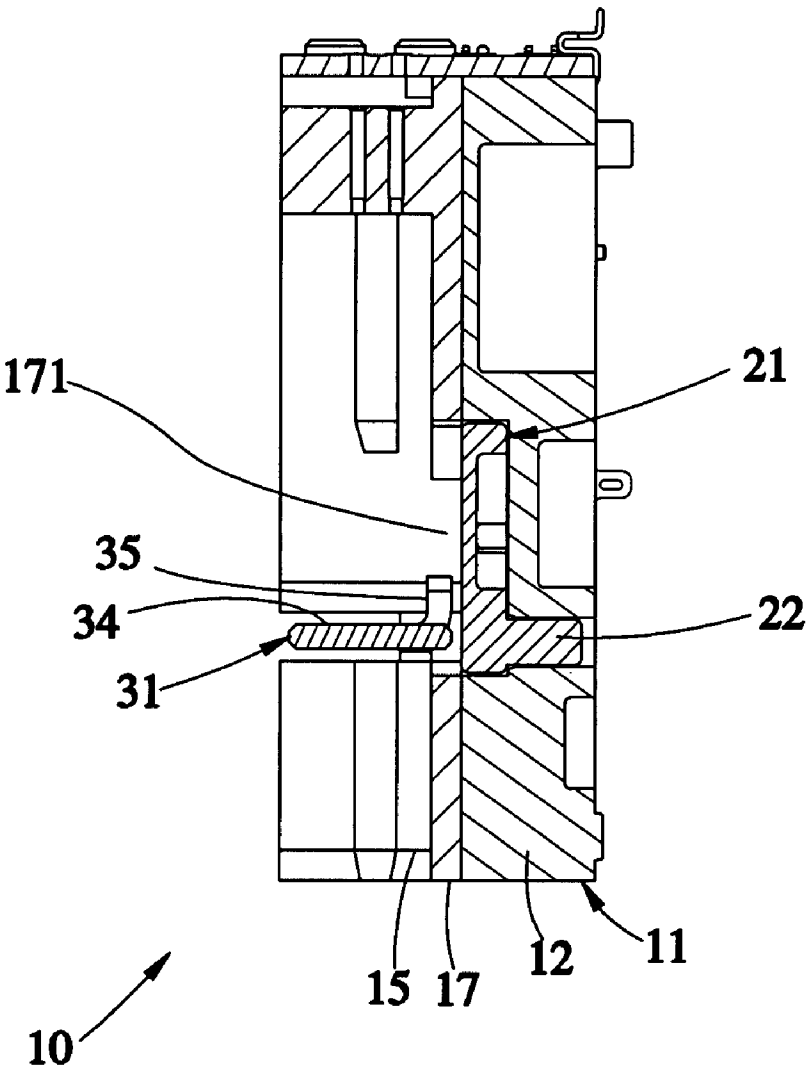
FIG. 5 is a sectional view taken from a line 5-5 indicated in FIG. 4.

Referring to FIGS. 1-5, a multi-purpose multiple-slot card connector 10 for use with a single card once only, constructed according to a preferred embodiment of the present invention, is composed of a base frame 11, a horizontal swivel member 21, a vertical pivot member 31, and a plurality of terminals 41.

The base frame 11 includes three slots defined as a left slot 13, a right slot 14, and an upper slot 15. The left and right slots 13 and 14 are adjacent to each other and spaced from each other by a partition 16. A spacer 17 is formed at a bottom side of the upper slot 15 and located above the partition 16 and the left and right slots 13 and 14. The upper slot 15 has a midsection located right above the partition 16. The spacer 17 has a first hollow portion 171 formed at a midsection thereof. The partition 16 has a second hollow portion 161 for communication between the left and right slots 13 and 14.

The swivel member 21 includes an axis 22 rotatably mounted to the base frame 11 and located between the left and right slots 13 and 14 and in the second hollow portion 161 for leftward and rightward swiveling movement driven by an external force on the axis 22. The swivel member 21 further includes two (left and right) stop walls 24, each of which has an imaginary line extending outward to intersect with the other for a predetermined angle. The two stop walls 24 can be moved together with the swivel member 21 for interference with the left and right slots 13 and 14 respectively while the swivel member 21 swivels.

The pivot member 31 includes a pivot shaft 32, a stop plate 34, and two (left and right) extensions 35, corresponding to the first hollow portion 171. The pivot shaft 32 has two ends pivotably mounted to two cavities 151 formed at two lateral sidewalls of the upper slot 15 of the base 11 respectively. The stop plate 34 extends outward from the pivot shaft 32. The two extensions 35 extend toward one side from the stop plate 34, being perpendicular to the stop plate 34 and spaced from each other for a predetermined interval. The pivot member 31 can be driven by an external force to pivot downward on the pivot shaft 32 and then the two extensions 35 are located above the left and right slots 13 and 14 respectively. While the pivot member 31 pivots downward, the two extensions 35 interferes with the left and right slots 13 and 14 and are located out of the range that the two stop walls 24 of the swivel member 21 swivel.

The terminals 41 are mounted in each of the slots 13, 14, and 15 for electric connection with respective inserted cards for connection with electronic signals of the inserted cards.

In this embodiment, the upper slot 15 corresponds to compact flash (CF) card, the left slot 13 corresponds to memory stick (MS) card, and the right slot 14 corresponds to MS Duo card.

FIG. 1 illustrates no card is inserted into the card connector 10.

Figure 6:
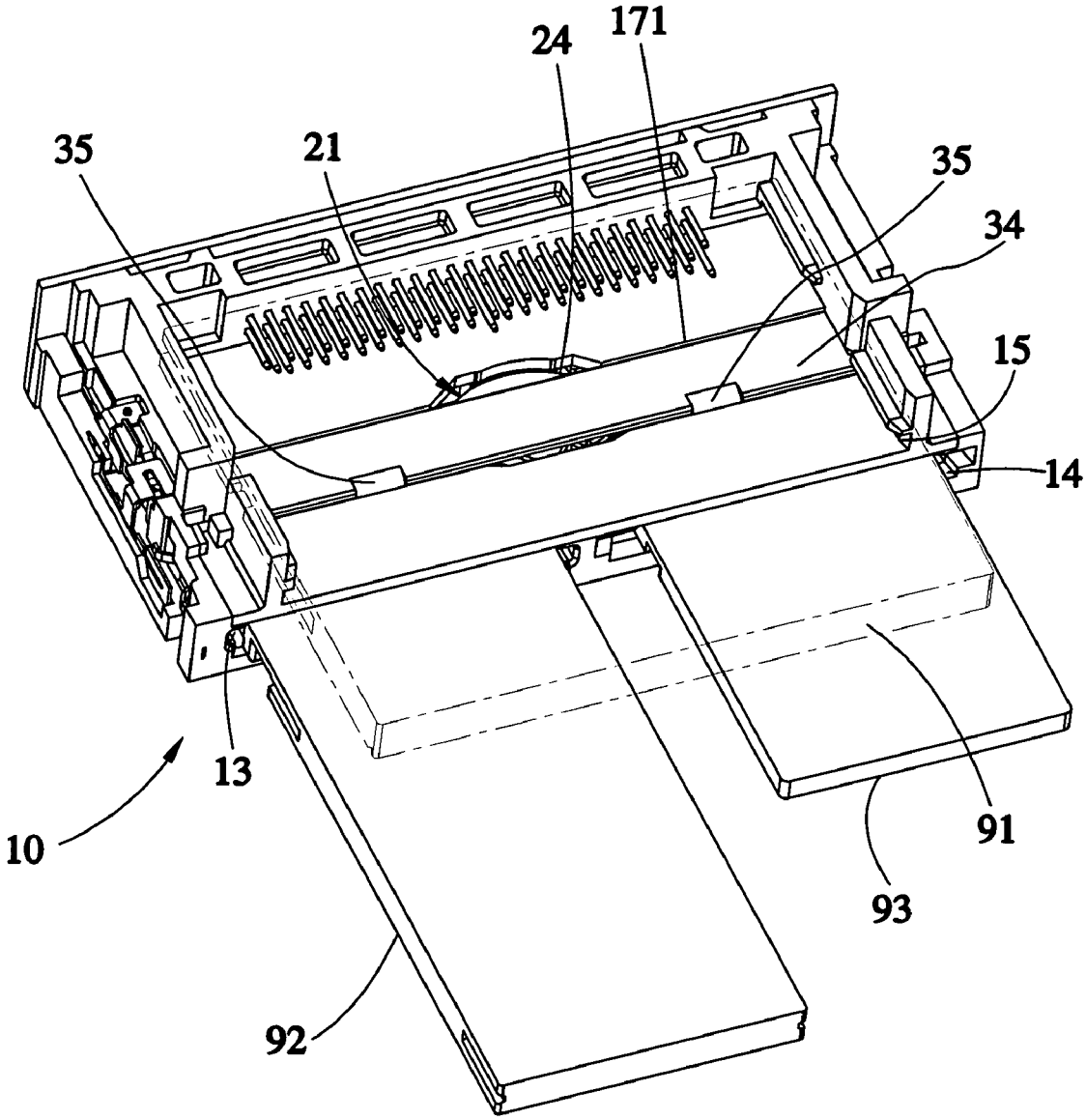
FIG. 6 is a schematic view of the preferred embodiment of the present invention at work, illustrating that a CF card is being inserted therein.

Referring to FIG. 6, during the insertion of a CF card 91 into the upper slot 15, the CF card 91 contacts against the stop plate 34 to drive the pivot member 31 to pass through the first hollow portion 171 and to pivot downward, and meanwhile, the two extensions 35 are moved together to interfere with the left and right slots 13 and 14. Because the two extensions 35 are located out of the range that the two stop walls 23 of the swivel member 21 swivel, the two extensions 35 will not bump into the swivel member 21 to avoid incorrect action. After the CF card 91 is inserted, if the user intends to insert an MS card 92 or an MS Duo card 93, the two extensions 35 will stop the MS card 92 or the MS Duo card 93 from insertion. It is to be noted that the CF card 91 is shown in imaginary lines to show what is located below the CF 91 in FIG. 6.

Figure 7:
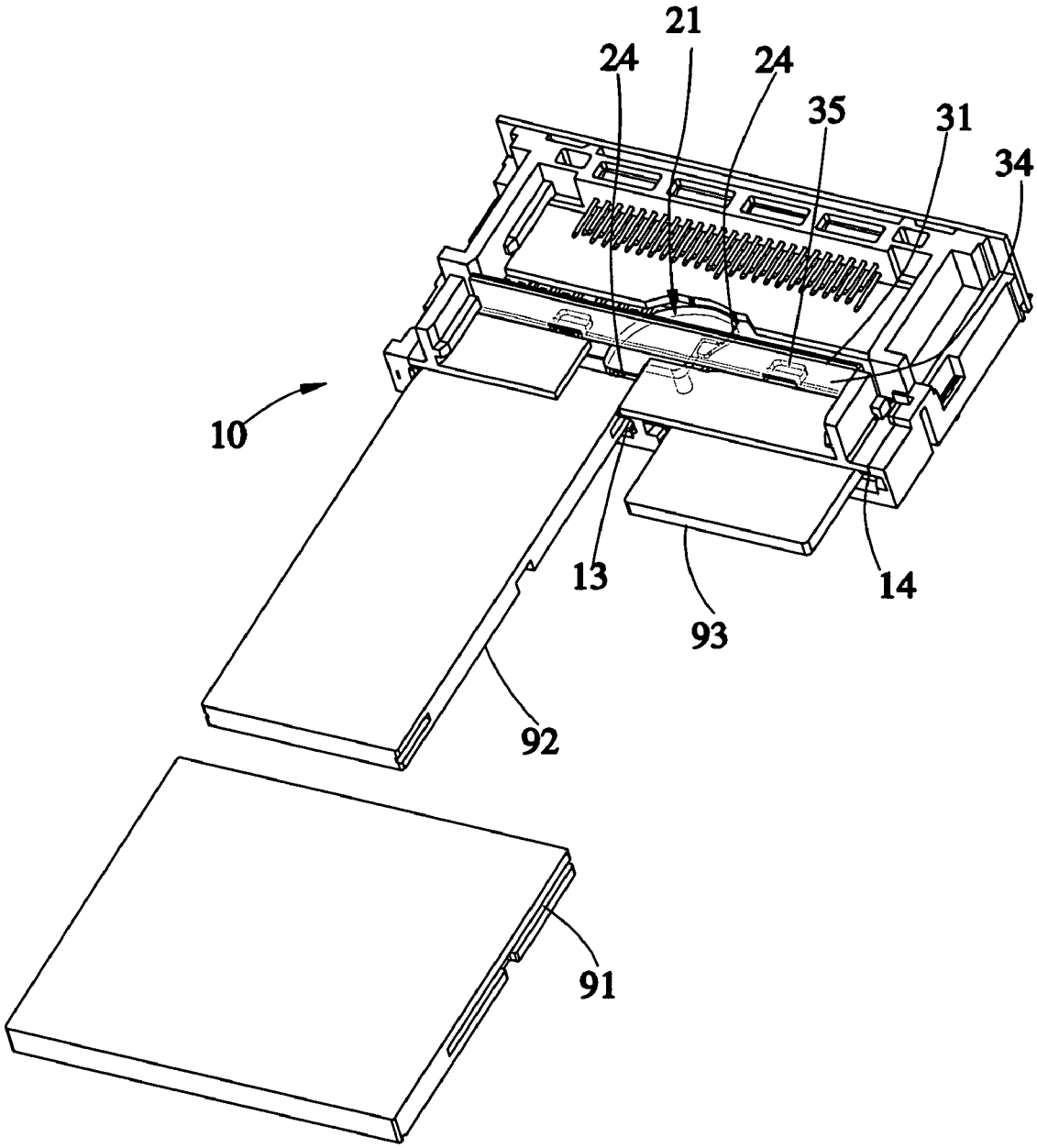
FIG. 7 is another schematic view of the preferred embodiment of the present invention at work, illustrating that an MS card is being inserted therein.

Referring to FIG. 7, while inserted into the left slot 13, the MS card 92 contacts against the left stop wall 24 to drive the swivel member 21 to swivel rightward and the right stop wall 24 interferes with the right slot 14. In the meantime, the pivot member 31 fails to pivot downward because the MS card 92 is inserted to occupy the left slot 13 to stop the left extension 35 from entry into the slot 13. After the MS card 92 is inserted, if the user intends to insert the CF card 91, because the pivot member 31 fails to pivot downward, the stop plate 34 will stop the CF card 91 from insertion; if the user intends to insert the MS Duo card 93, the right stop wall 24 of the swivel member 21 will stop the MS Duo card 93 from insertion.

Figure 8:
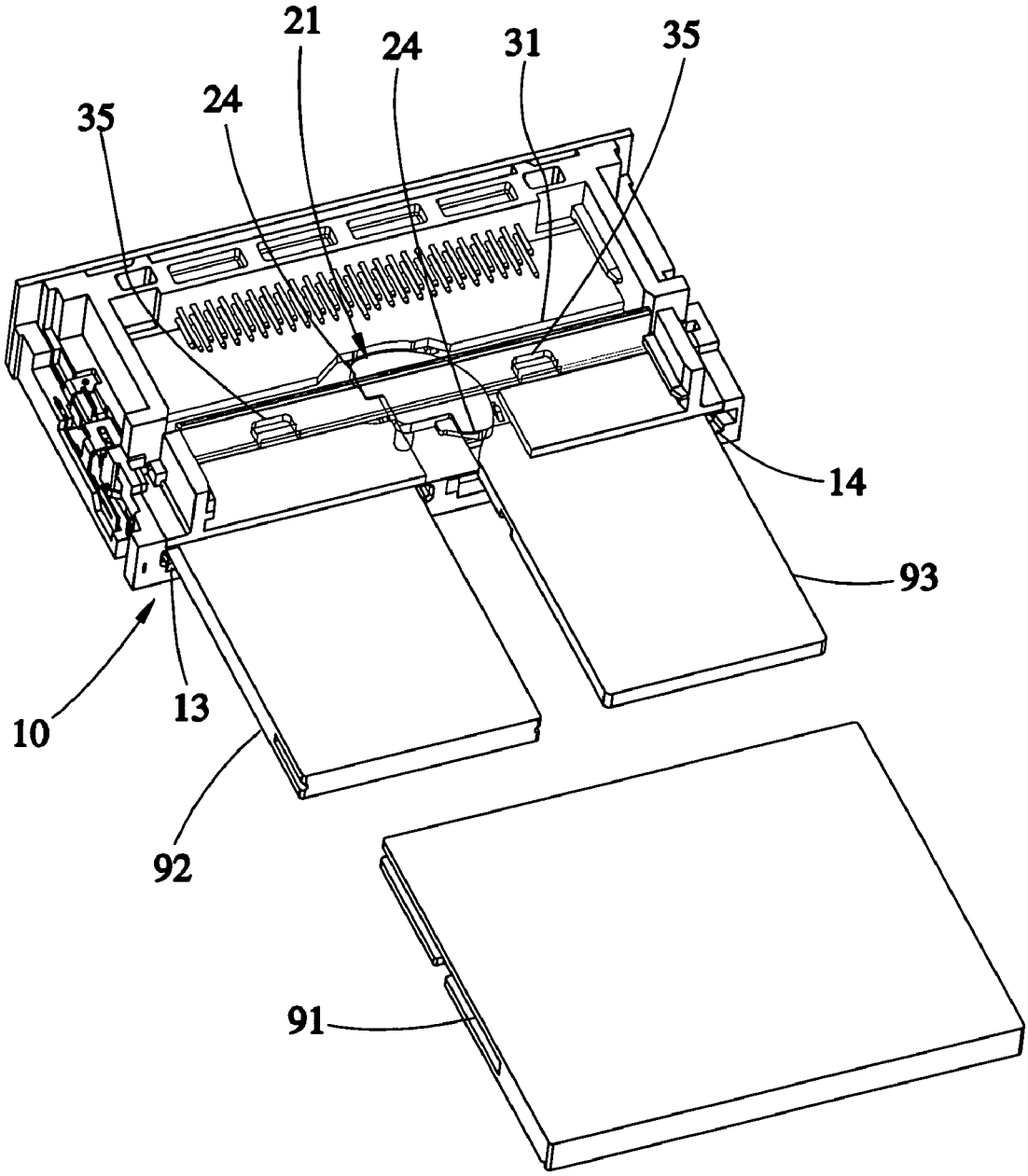
FIG. 8 is another schematic view of the preferred embodiment of the present invention at work, illustrating that an MS Duo card is being inserted therein.

Referring to FIG. 8, while inserted into the right slot 14, the MS Duo card 93 contacts against the right stop wall 24 of the swivel member 21 to drive the swivel member 21 to swivel leftward and the left stop wall 24 interferes with the left slot 13. In the meantime, the pivot member 31 fails to pivot downward because the MS Duo card 93 is inserted to occupy the right slot 14 to stop the right extension 35 from entry into the right slot 14. After the MS Duo card 93 is inserted, if the user intends to insert the CF card 91, because the pivot member 31 fails to pivot downward, the stop plate 34 will stop the CF card from insertion; if the user intends to insert the MS card 92, the left stop wall 24 of the swivel member 21 will stop the MS card from insertion.

Figure 9:
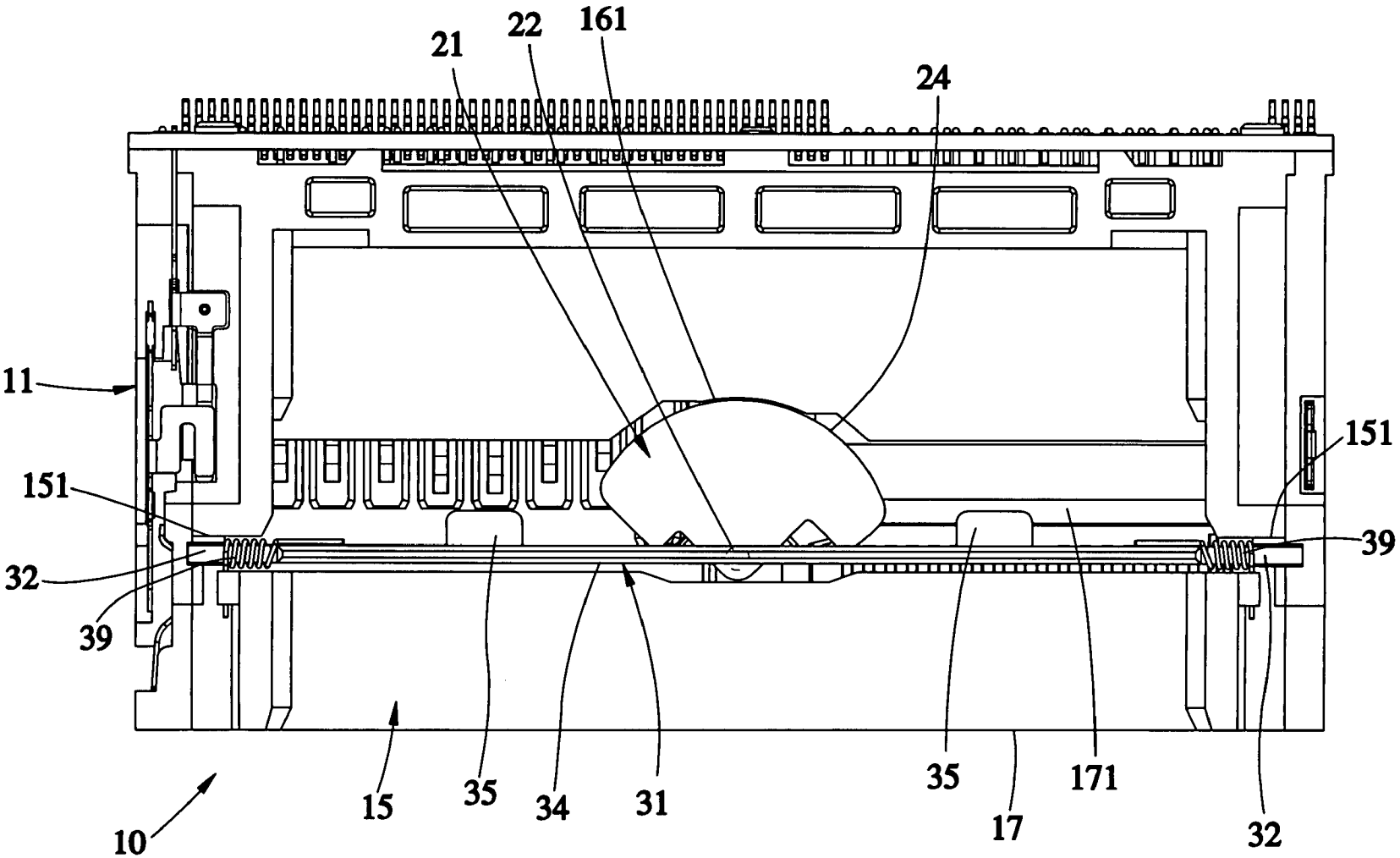
FIG. 9 is a top view of the preferred embodiment of the present invention, illustrating that two torsion springs are additionally mounted.

The card connector 10 further includes at least one torsion spring 39 fitted onto the pivot shaft 32 of the swivel member 31. Referring to FIG. 9, there are two torsion springs 39 in this embodiment. The two torsion springs 39 can work on the stop plate 34 and two sidewalls of the cavities 151 respectively to keep the stop plate 34 standing. The torsion springs 39 can keep the extensions 35 from interference with the left and right slots 13 and 14 and the user may feel less unsmooth while inserting a card into the left or right slot 13 or 14, while no card is inserted into the upper slot 15. Further, while a card is inserted into the upper slot 15, the pivot member 31 can still be forced to pivot downward.

In conclusion, the present invention includes multiple slots for insertion of multiple cards and prevents any other card from insertion after a card is inserted therein, thus being multi-purpose, multi-slot, and for use with one single card at a time only to achieve the purpose of the present invention.

Although the present invention has been described with respect to a specific preferred embodiment thereof, it is no way limited to the details of the illustrated structures but changes and modifications may be made within the scope of the appended claims.

What is claimed is:

1. A multi-purpose multiple-slot card connector for use with a single card once only, comprising:

a base frame having three slots defined as a left slot, a right slot, and an upper slot, a spacer formed at a bottom side of said upper slot for spacing said upper slot from said left and right slots, and a first hollow portion formed at a midsection of said spacer, wherein said left and right slots are adjacent to each other and spaced from each other by a partition and said spacer is located above said partition, said left slot, and said right slot;

a horizontal swivel member having an axis and two stop walls, for leftward and rightward swiveling movement driven by an external force on said axis, said axis being rotatably mounted to said base frame and located between said left and right slots, said two stop walls each having an imaginary line extending outward to intersect with the other for a predetermined angle, wherein said two stop walls can be moved together with said swivel member to interfere with said left slot or said right slot while said swivel member swivels;

a vertical pivot member corresponding to said first hollow portion and having a pivot shaft, a stop plate, and two extensions, for downward pivoting movement driven by an external force on said pivot shaft, said pivot shaft being pivotably mounted to said base frame and located at two lateral sidewalls of said upper slot, said stop plate extending outward from said pivot shaft, said two extensions extending toward a side from said stop plate and located above said left and right slots respectively, wherein while said pivot member pivots downward, said two extensions interfere with said left and right slots; and a plurality of terminals mounted in each of said slots.

2. The card connector as defined in claim 1, wherein said upper slot has a midsection located right above said partition.

3. The card connector as defined in claim 1, wherein said two extensions are perpendicular to said stop plate.

4. The card connector as defined in claim 1, wherein said partition comprises a second hollow portion for communication between said left and right slots; said swivel member is located in said second hollow portion.

5. The card connector as defined in claim 1, wherein said two extensions are spaced from each other for a predetermined interval and located out of a range that said two stop walls swivel.

6. The card connector as defined in claim 1 further comprising at least one torsion spring fitted onto said pivot shaft of said pivot member for working on said stop plate and said base frame for keeping said stop plate standing.

* * * * *